US008605026B2

(12) United States Patent
Ko et al.

(10) Patent No.: US 8,605,026 B2
(45) Date of Patent: Dec. 10, 2013

(54) TIMING CONTROLLER, LIQUID CRYSTAL DISPLAY HAVING THE SAME, AND METHOD OF DRIVING LIQUID CRYSTAL DISPLAY

(75) Inventors: Hyun-seok Ko, Seoul (KR); Myeong-su Kim, Cheonan-si (KR)

(73) Assignee: Samsung Display Co., Ltd. (KR)

( * ) Notice: Subject to any disclaimer, the term of this patent is extended or adjusted under 35 U.S.C. 154(b) by 1048 days.

(21) Appl. No.: 12/143,992

(22) Filed: Jun. 23, 2008

(65) Prior Publication Data

US 2009/0102776 A1 Apr. 23, 2009

(30) Foreign Application Priority Data

Oct. 18, 2007 (KR) ..... 10-2007-0105196

(51) Int. Cl.
*G09G 3/36* (2006.01)

(52) U.S. Cl.
USPC ..... 345/99; 345/100

(58) Field of Classification Search
USPC ..... 345/99, 100
See application file for complete search history.

(56) References Cited

U.S. PATENT DOCUMENTS

| | | | | |
|---|---|---|---|---|
| 6,140,946 | A * | 10/2000 | Desrosiers et al. | 341/100 |
| 6,340,970 | B1 * | 1/2002 | Furuhashi et al. | 345/213 |
| 6,867,759 | B1 * | 3/2005 | Baek et al. | 345/99 |
| 7,190,361 | B2 | 3/2007 | Igarashi et al. | |
| 7,505,016 | B2 | 3/2009 | Kwon | |
| 2001/0022571 | A1 * | 9/2001 | Nakano et al. | 345/98 |
| 2003/0011547 | A1 | 1/2003 | Igarashi et al. | |
| 2003/0020683 | A1 * | 1/2003 | Waterman | 345/98 |
| 2006/0208999 | A1 | 9/2006 | Lee et al. | |
| 2006/0279522 | A1 * | 12/2006 | Kurihara | 345/102 |
| 2007/0152926 | A1 | 7/2007 | Kwon | |
| 2009/0160756 | A1 * | 6/2009 | Van Beek et al. | 345/102 |
| 2010/0002027 | A1 * | 1/2010 | Krijn et al. | 345/694 |

FOREIGN PATENT DOCUMENTS

| | | |
|---|---|---|
| CN | 1991967 A | 7/2007 |
| JP | 11-065535 | 3/1999 |
| JP | 2006-145798 | 6/2006 |
| KR | 10-2007-0067958 | 6/2007 |

OTHER PUBLICATIONS

Korean Patent Abstracts—Korean Intellectual Property Office—Publication No. 1020070067958 A, Publication Date Jun. 29, 2007, 2 pages.
European Search Report, EP 08017937.7, May 11, 2010, 8 pages.

* cited by examiner

*Primary Examiner* — Jonathan Boyd
(74) *Attorney, Agent, or Firm* — Innovation Counsel LLP

(57) ABSTRACT

A liquid crystal display includes a first timing controller for receiving image signals in synchronization with a first clock signal and outputting representative image signals in synchronization with a second clock signal, the frequency of the second clock signal being lower than the frequency of the first clock signal; and circuitry for controlling luminance of light-emitting blocks of the liquid crystal display in response to the representative image signals.

19 Claims, 10 Drawing Sheets

TIMING CONTROLLER, LIQUID CRYSTAL DISPLAY HAVING THE SAME, AND METHOD OF DRIVING LIQUID CRYSTAL DISPLAY

CROSS-REFERENCE TO RELATED APPLICATION

This application claims priority from South Korean Patent Application No. 10-2007-0105196, filed on Oct. 18, 2007 in the Korean Intellectual Property Office, the disclosure of which is incorporated herein in its entirety by reference.

BACKGROUND OF THE INVENTION

1. Field of the Invention

The present invention relates to a timing controller, a liquid crystal display having the same, and a method of driving a liquid crystal display.

2. Description of the Related Art

A liquid crystal display (LCD) includes a liquid crystal display panel (LCD panel) which includes a first display plate having pixel electrodes, a second display plate having a common electrode, and a liquid crystal layer having dielectric anisotropy and injected between the first display plate and the second display plate. An electric field is formed between the pixel electrodes and the common electrode. The intensity of the electric field controls the amount of light transmitted through the LCD panel, thus forming a desired image on the LCD panel. Since the LCD is not self-luminous, it includes light-emitting blocks.

Such an LCD may include a first timing controller and a second timing controller. The first timing controller receives external image signals and control signals, and controls a gate driver and a data driver. The first timing controller provides to the second timing controller information about the image displayed on the LCD panel, and second timing controller controls the luminance of the light-emitting blocks in accordance with this information. This information is transmitted by the first timing controller to the second timing controller at a high frequency, possibly generating significant electromagnetic interference (EMI).

SUMMARY OF THE INVENTION

Some embodiments of the present invention educe this electromagnetic interference (EMI).

The invention is not limited to the features and advantages described in this section. Other advantages and features of the invention are set forth in subsequent sections.

In order to accomplish these objects, there is provided a timing controller, according to the present invention, which includes a representative-value generator receiving a plurality of image signals in synchronization with a first clock signal and determining a plurality of representative image signals; and a serializer outputting in series the representative image signals in synchronization with a second clock signal; wherein the frequency of the second clock signal is lower than the frequency of the first clock signal.

In another aspect of the present invention, there is provided a liquid crystal display, which includes a first timing controller receiving image signals in synchronization with a first clock signal and outputting representative image signals in synchronization with a second clock signal, the frequency of the second clock signal being lower than the frequency of the first clock signal; a second timing controller outputting backlight data signals corresponding to the representative image signals; and a backlight driver controlling the luminance of light-emitting blocks in response to the backlight data signals.

In still another aspect of the present invention, there is provided a method of driving a liquid crystal display, which includes receiving image signals in synchronization with a first clock signal and outputting representative image signals in synchronization with a second clock signal, the frequency of the second clock signal being lower than the frequency of the first clock signal; providing backlight data signals corresponding to the representative image signals; and controlling the luminance of light-emitting blocks in response to the backlight data signals.

BRIEF DESCRIPTION OF THE DRAWINGS

The above and other objects, features and advantages of the present invention will be apparent from the following detailed description taken in conjunction with the accompanying drawings, in which.

DETAILED DESCRIPTION OF SOME EMBODIMENTS

Figure 1:
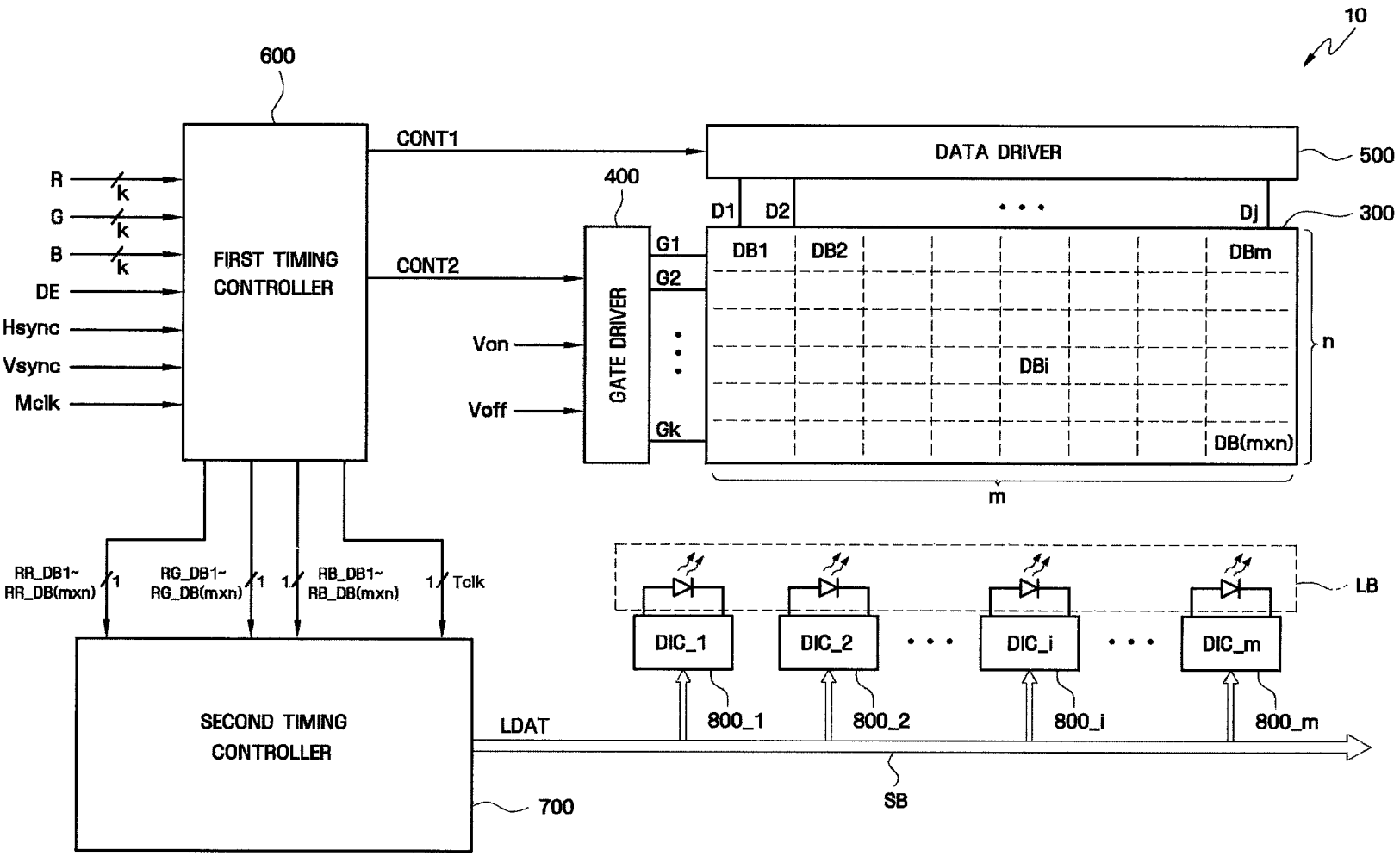
FIG. 1 is a block diagram of a liquid crystal display according to some embodiments of the present invention.

Some embodiments of the present invention will now be described in detail with reference to the accompanying drawings. These embodiments illustrate but do not limit the invention. The invention is not limited to particular features of these embodiments.

In different drawings, the same reference numerals denote similar elements.

The phrases "connected to" and "coupled to" may mean direct connection or coupling and may also mean connection or coupling via intermediate elements. The phrases "directly connected to" and "directly coupled to" mean connection or coupling without an intermediate element.

When describing different elements, the labels such as "first", "second", etc. are used merely for ease of reference and not to limit the invention to any order of elements unless indicated to the contrary.

Also, the description below refers to a first timing controller and a second timing controller. The term "timing controller", when taken alone, may refer to any one or both of the first and second timing controllers.

Figure 2:
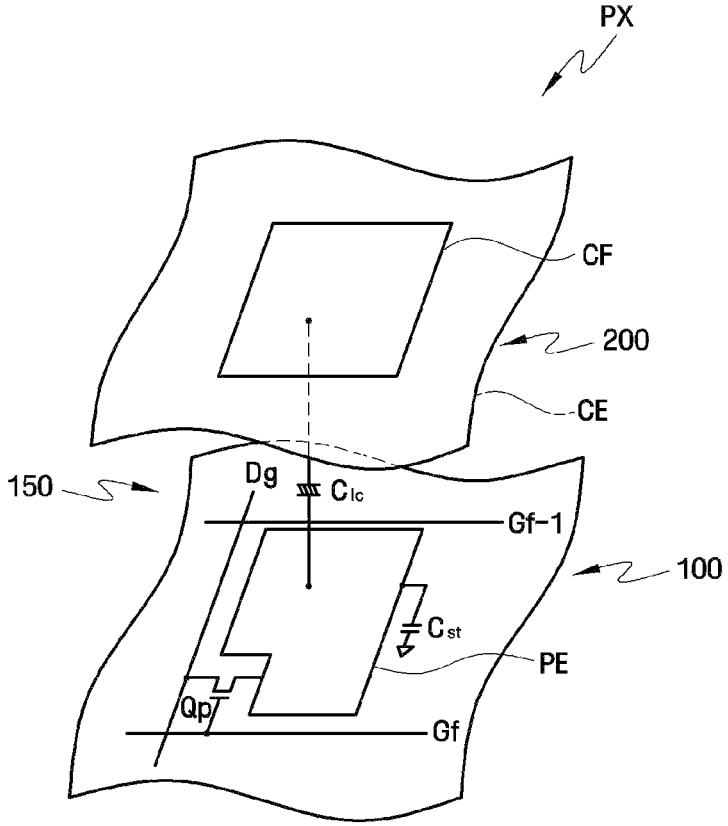
FIG. 2 is a circuit diagram of one pixel of the liquid crystal display of FIG. 1.
Figure 3:
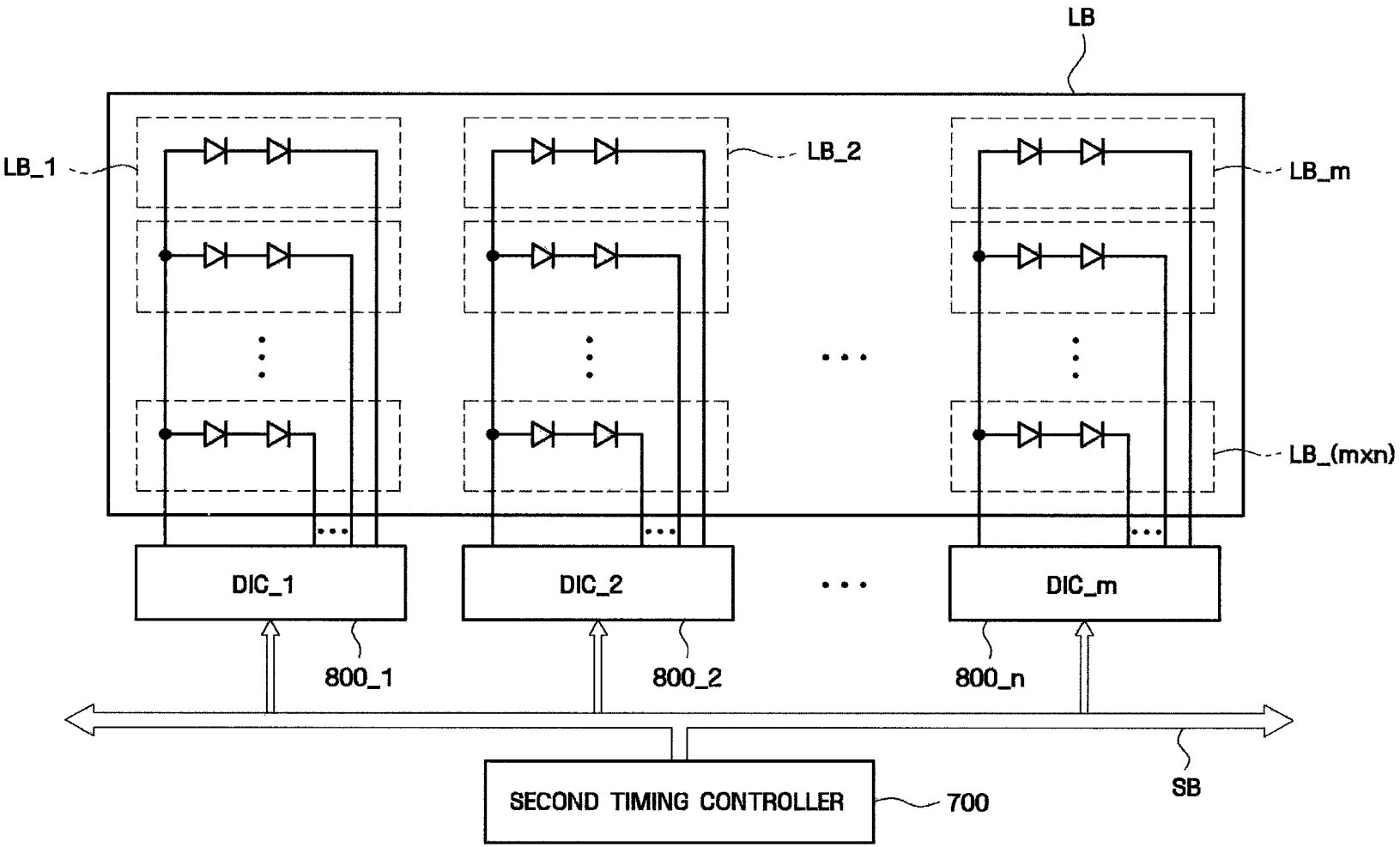
FIG. 3 is a block diagram illustrating light-emitting blocks and a backlight driver in the liquid crystal display of FIG. 1.
Figure 4:
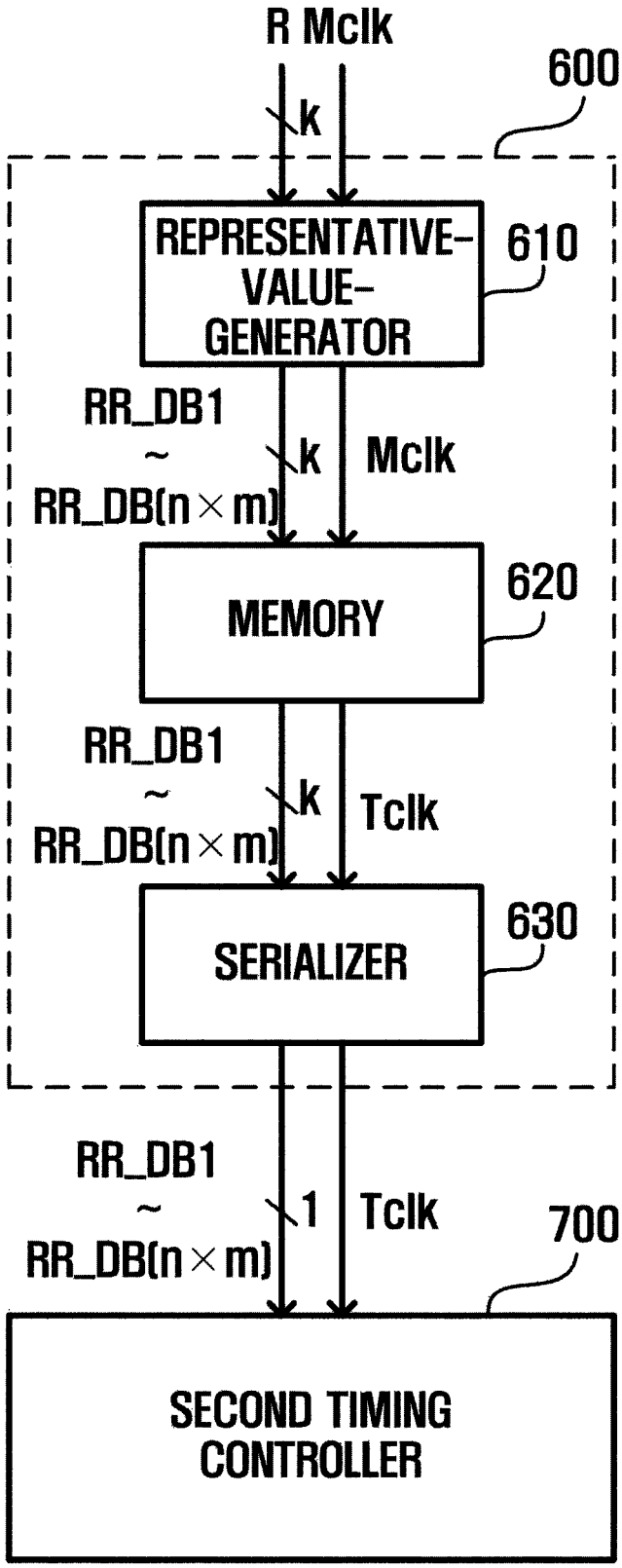
FIG. 4 is a block diagram of the first timing controller of FIG. 1.
Figure 5:
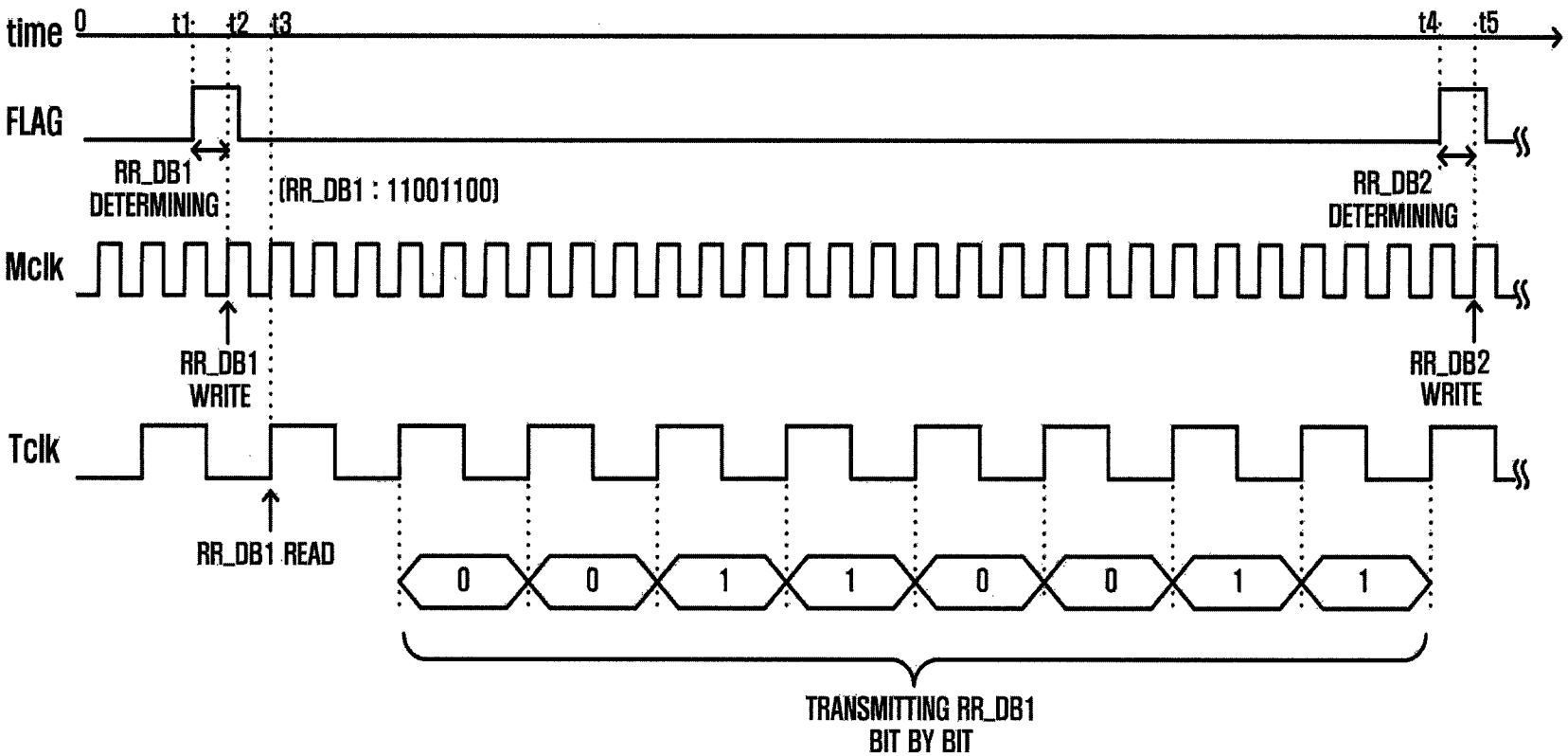
FIG. 5 is a timing diagram illustrating the operation of the first timing controller of FIG. 4.
Figure 6:
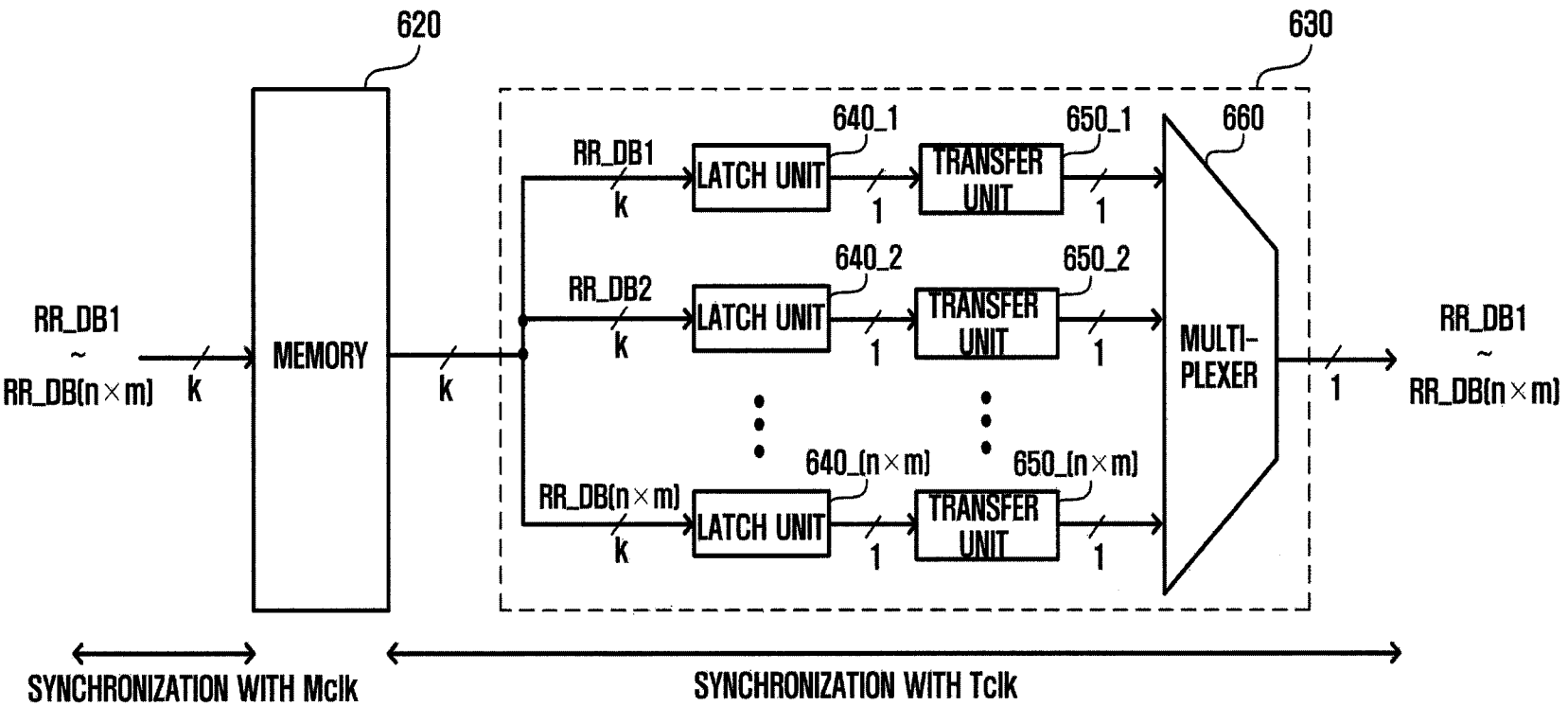
FIG. 6 is a block diagram of a serializer of FIG. 4.

A liquid crystal display according to some embodiments of the present invention will now be described with reference to FIGS. 1 to 6. FIG. 1 is a block diagram of some features of the liquid crystal display, including the first and second timing controllers. FIG. 2 is a circuit diagram of one pixel of the display. FIG. 3 is a block diagram illustrating the light-emitting blocks and a backlight driver. FIG. 4 is a block diagram illustrating the first timing controller in detail. FIG. 5 is a timing diagram illustrating the operation of the first timing controller. FIG. 6 is a block diagram illustrating a serializer of FIG. 4.

The liquid crystal display (LCD) 10 of FIG. 1 includes an LCD panel 300; a gate driver 400; a data driver 500; a first timing controller 600; a second timing controller 700; m backlight drivers 800_1, . . . , 800_*m*; and light-emitting blocks LB (FIG. 3) connected to the respective backlight drivers 800_1, . . . , 800_*m*.

The LCD panel 300 is subdivided into n×m display blocks DB1, . . . , DB(n×m). Each display block DBs (1≤s≤n×m) includes a plurality of pixels. The display blocks DB1, . . . , DB(n×m) are arranged in a matrix with n rows and m columns. Each display block DBs corresponds to a respective light-emitting block LBs.

The LCD panel 300 includes a plurality of gate lines G1, . . . , Gi and a plurality of data lines D1, . . . , Dj.

A circuit diagram of one pixel PX is illustrated in FIG. 2. The pixel PX is connected to an f-th gate line Gf (1≤f≤i) and a g-th data line Dg (1≤g≤j). The pixel PX includes a switching element Qp connected to the gate line Gf and the data line Dg. A liquid crystal capacitor Clc and a storage capacitor Cst are connected to the switching element. The liquid crystal capacitor Clc includes a pixel electrode PE in a first display plate 100 and a common electrode CE in a second display plate 200. The pixel PX also includes a color filter CF formed over the common electrode CE.

The gate driver 400 receives a gate control signal CONT2 from the first timing controller 600, and applies gate signals to the gate lines G1, . . . , Gk. Each gate signal alternates between a gate-on voltage Von and a gate-off voltage Voff. The gate control signal CONT2 controls the gate driver 500, and includes a vertical start signal for starting the operation of the gate driver 500, a gate clock signal for determining the time when the gate-on voltage is output, and an output enable signal for determining the pulse width of the gate-on voltage.

The data driver 500 receives a data control signal CONT1 from the first timing controller 600, and applies image data voltages to the data lines D1, . . . , Dj. The data control signal CONT1 includes image data signals corresponding to RGB image signals and also includes a signal for controlling the operation of the data driver 500. The signal for controlling the operation of the data driver 500 includes a horizontal start signal for starting the operation of the data driver 500, and an output command signal for initiating the driving of image data voltages.

One or both of the gate driver 400 and the data driver 500 can be mounted on a flexible printed circuit film or films (not illustrated), and then can be attached to the LCD panel 300 as a tape carrier package. Alternatively, the gate driver 400 and/or the data driver 500 may be integrated into the LCD panel 300 together with the display signal lines G1, . . . , Gi and D1, . . . , Dj, the switching elements Qp, and other elements.

An external graphics controller (not shown) provides to the first timing controller 600 a number of signals including the RGB image signals R, G, and B and external control signals Vsync, Hsync, Mclk, and DE for controlling the display of the RGB image signals. The data control signal CONT1 and the gate control signal CONT2 are generated based on the RGB image signals and the control signals Vsync, Hsync, Mclk, and DE. The external control signal Vsync is a vertical sync signal, Hsync is a horizontal sync signal, Mclk is a main clock signal, and DE is a data enable signal. The receipt of the RGB image signals is synchronized by the main clock signal Mclk. In an exemplary embodiment, the RGB image signals R, G, and B are 8-bit (k=8) signals received in parallel on 24 lines.

The first timing controller 600 receives the RGB image signals in synchronization with the main clock signal Mclk. For each display block DBs (1≤s≤n×m), the first timing controller 600 generates representative image signals RR_DBs, RG_DBs, and RB_DBs. The first timing controller 600 provides these representative image signals RR_DB1, . . . , RR_DB(n×m), RG_DB1, . . . , RG_DB(n×m), RB_DB1, . . . , RB_DB(n×m) to the second timing controller 700 in synchronization with a transfer clock signal Tclk. The frequency of the transfer clock signal Tclk is lower than the frequency of the main clock signal Mclk. The representative image signals RR_DB1, . . . , RR_DB(n×m) may be provided in series.

For each display block DBs, the representative image signal RR_DBs is a function of the R image signals in the display block DBs; the representative image signal RG_DBs is a function of the G image signals in the display block DBs; and the representative image signal RB_DBs is a function of the B image signals in the display block DBs. In some embodiments, the first timing controller 600 outputs the representative image signals RR_DBs, RG_DBs, RB_DBs to the second timing controller 700 in order starting with s=1 (i.e. for display block DB1), then for s=2, then for s=3, and so on. The output is synchronized by the transfer clock signal Tclk.

In this manner, the first timing controller 600 generates the representative image signals RR_DB1, . . . , RR_DB(n×m), RG_DB1, . . . , RG_DB(n×m), RB_DB1, . . . , RB_DB(n×m) for the respective display blocks DB1, . . . , DB(n×m), and outputs the representative image signals to the second timing controller 700.

In some embodiments, each representative image signal RR_DBs is the average value of the R signals in the respective display block DBs; each representative image signal RG_DBs is the average value of the G signals in the display block DBs; and each representative image signal RB_DBs is the average value of the B signals in the display block DBs. Alternatively, the representative image signals RR_DBs, RG_DBs, RB_DBs can be maximum values of the respective signals R, G, B in the display block DBs. Other methods for determining the representative image signals can also be used.

The second timing controller 700 receives the representative image signals RR_DB1, . . . , RR_DB(n×m), RG_DB1, . . . , RG_DB(n×m), RB_DB1, . . . , RB_DB(n×m) in synchronization with the transfer clock signal Tclk, and generates corresponding backlight data signals LDAT that are provided to the backlight drivers 800_1, . . . , 800_*m* (via a serial bus SB for example).

The backlight drivers 800_1, . . . , 800_*m* are connected to the respective light-emitting blocks LB1, . . . , LB(n×m), and control the luminances of the respective light-emitting blocks LB1, . . . , LB(n×m) in response to the backlight data signals LDAT. As illustrated in FIG. 3, the light-emitting blocks LB1, . . . , LB(n×m) may be arranged in an (n×m) matrix corresponding to the matrix of the display blocks DB1, . . . , DB(n×m). In this example, m backlight drivers 800_1, . . . , 800_*m* are provided. Each backlight driver is connected to the respective column of the light-emitting blocks LB1, . . . , LB(n×m) to control the luminances of the light-emitting blocks in that column. The backlight drivers 800_1, . . . , 800_*m* control the luminances of the respective light-emitting blocks LB1, . . . , LB(n×m) by outputting pulse width modulation (PWM) signals in response to the backlight data signals LDAT. Alternatively, the luminances can be controlled by the backlight drivers 800_1, . . . , 800_*m* adjusting the current flowing to the respective light-emitting blocks LB1, . . . , LB(n×m) in response to the backlight data signals LDAT. These methods of controlling the luminances of the light-emitting blocks LB1, . . . , LB(n×m) by the backlight drivers 800_1, . . . , 800_*m* are not limiting.

In summary, the second timing controller 700 receives the representative image signals RR_DB1, . . . , RR_DB(n×m), RG_DB1, . . . , RG_DB(n×m), and RB_DB1, . . . , RB_DB (n×m) for the respective display blocks DB1, . . . , DB(n×m) from the first timing controller 600, and provides the corresponding backlight data signals LDAT to the respective backlight drivers 800_1, . . . , 800_*m*. The luminances of the respective light-emitting blocks LB1, . . . , LB(n×m) are controlled to correspond to the backlight data signals LDAT.

In this embodiment, the first timing controller 600 provides the representative image signals RR_DB1, . . . , RR_DB(n×m) to the second timing controller 700 in synchronization with the transfer clock signal Tclk having a low frequency. For example, the frequency of the transfer clock signal Tclk can be lower than the frequency of the main clock signal Mclk. Therefore, the EMI is reduced.

Referring to FIG. 4, the first timing controller 600 includes a representative-value generator 610, a memory 620, and a serializer 630. The operation of these components will be illustrated on the example of the R image signals.

The representative-value generator 610 receives the R image signals in synchronization with the main clock signal Mclk, and generates the representative image signals RR_DB1, . . . , RR_DB(n×m) for the respective display blocks DB1, . . . , DB(n×m).

In the example of FIG. 5, the R image signals for the first display block DB 1 are received by the first timing controller 600 in synchronization with the main clock signals Mclk during a time period from a time 0 to a time t1. Then the representative-value generator 610 is enabled by a flag signal FLAG, and generates the representative image signal RR_DB1 that corresponds to the first display block DB1.

In the time period from 0 to t1, some embodiments may receive not only the R image signals for the display block DB1 but also the R image signals for other display blocks DBs (s>1), including possibly the display blocks DB2, . . . , DBm, or even all the blocks DB2, . . . , DB(n×m). These R image signals may correspond to more than one of the gate lines G1, . . . , Gi. In particular, some embodiments allow receipt of the R image signals for one or more rows of the display blocks (e.g. the first row of the display blocks consists of the blocks DB1, . . . , DBm). Each row of the display blocks includes all the pixels connected to a number of gate lines. Accordingly, the liquid crystal display includes a memory (not illustrated) for temporary storage of the R image signals. The representative-value generator then reads the R image signals from the memory as needed. Thus, at about the time t1, in response to the flag signal FLAG, the representative-value generator reads the R image signals for the first display block DB1 from the memory (not illustrated) in synchronization with the main clock signal Mclk, and generates the representative image signal RR_DB1 for the first display block DB1. The memory may store the R image signals for one or more rows of the display blocks DB1, . . . , DB(n×m). In the example of FIG. 5, the representative image signal RR_DB1 is an 8-bit signal whose value is 11001100.

The flag signal FLAG may be generated in the representative-value generator 610 or externally provided.

The representative image signal RR_DB1 for the first display block DB1 is written to the memory 620 at a time t2, possibly in synchronization with the main clock signal Mclk. In the example of FIG. 5, the 8 bits 11001100 of the representative image signal may be written to the memory 620 in parallel. In some embodiments, the writing of the representative image signal RR_DB1 to the memory 620 is synchronized by a clock signal other than Mclk. The invention is not limited to a particular clock signal or to the number of bits in the representative image signal; the number of bits may be larger or smaller than 8.

At a time t3, the serializer 630 reads out the representative image signal RR_DB1 for the first display block DB1 from the memory 620, possibly in synchronization with the transfer clock signal Tclk or some other clock signal. Then the serializer 630 serially transmits the representative image signal RR_DB1, one bit at a time, to the second timing controller 700 in synchronization with the transfer clock signal Tclk. For example, the representative image signal can be transmitted starting from the least significant bit (LSB) to the most significant bit (MSB). The frequency of the transfer clock signal Tclk is lower than the frequency of the main clock signal Mclk. In some embodiments, the frequency of the main clock signal Mclk is about 140 MHz, and the frequency of the transfer clock signal Tclk is about 4 MHz. The detailed construction of the serializer 630 is described below.

Then the representative-value generator 610 receives the R image signals for the second display block DB2, and is enabled by the flag signal FLAG at a time t4 to generate the representative image signal RR_DB2 for the second display block DB2. Using the same method as for the display block DB1, the representative-value generator 610 reads out the R image signals for the second display block DB2 from the memory (not illustrated), and is enabled by the flag signal FLAG at time t4 to generate the representative image signal RR_DB2 for the second display block DB2. At a time t5, the representative-value generator 610 writes the representative image signal RR_DB2 for the second display block DB2 to the memory 620. In this operation, the representative image signal RR_DB2 is written in synchronization with the main clock signal Mclk. In this manner, the representative image signals RR_DB2, . . . , RR_DB(n×m) are successively generated and serially transmitted to the second timing generator 700 in synchronization with the transfer clock signal Tclk.

In summary, the first timing controller 600 receives the RGB image signals in synchronization with the main clock signal Mclk (for example, about 140 MHz). The first timing controller 600 outputs the representative image signals RR_DB1, . . . , RR_DB(n×m) to the second timing controller 700 in synchronization with the slower transfer clock signal Tclk (e.g. about 4 MHz). The lower frequency of the transfer clock signal Tclk serves to lower the EMI during transmission of the representative image signals RR_DB1, . . . , RR_DB (n×m) to the second timing controller 700.

FIG. 6 illustrates some features of the serializer 630 of FIG. 4. The serializer 630 includes a plurality of latch units 640_1, . . . , 640_(n×m), a plurality of transfer units 650_1, . . . , 650_(n×m), and a multiplexer 660.

The serializer 630 reads out the representative image signals RR_DB1, . . . , RR_DB(n×m) from the memory 620 in synchronization with the transfer clock signal Tclk, and serially outputs the representative image signals RR_DB1, . . . , RR_DB(n×m). For simplicity, the input and output terminals used to carry the main clock signal Mclk and the transfer clock signal Tclk are not illustrated in the drawing.

The respective latch units 640_1, . . . , 640_(n×m) read out the representative image signals, such as 8-bit representative image signals RR_DB1, . . . , RR_DB(n×m), from the memory 620 in synchronization with the transfer clock signal Tclk. The respective transfer units 650_1, . . . , 650_(n×m)

read the respective representative image signals RR_DB1, . . . , RR_DB(n×m) from the respective latch units 640_1, . . . , 640_(n×m) one bit at a time in synchronization with the transfer clock signal Tclk, and provide the bits one at a time to the multiplexer 660 in synchronization with the transfer clock signal Tclk.

The multiplexer 660 serially transmits the bits provided by the transfer units 650_1, . . . , 650_(n×m). For example, the multiplexer 660 may transmit the output of the first transfer unit 650_1, then the output of the second transfer unit 650_2, and so on until the (n×m)-th transfer unit 650_(n×m).

In some embodiments, the multiplexer 660 is omitted. The transfer units 650_1, . . . , 650_(n×m) successively output the representative image signals RR_DB1, . . . , RR_DB(n×m).

Figure 7A:
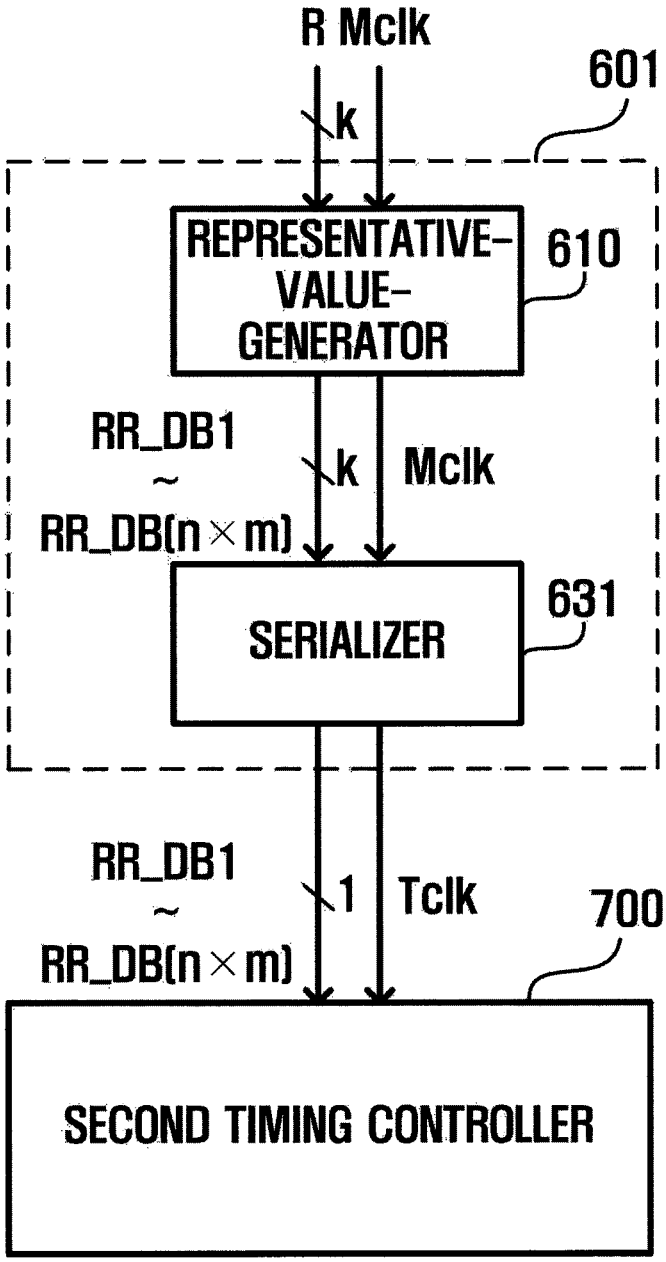
FIG. 7A is a block diagram of the first and second timing controllers in a liquid crystal display according to some embodiments of the present invention.
Figure 7B:
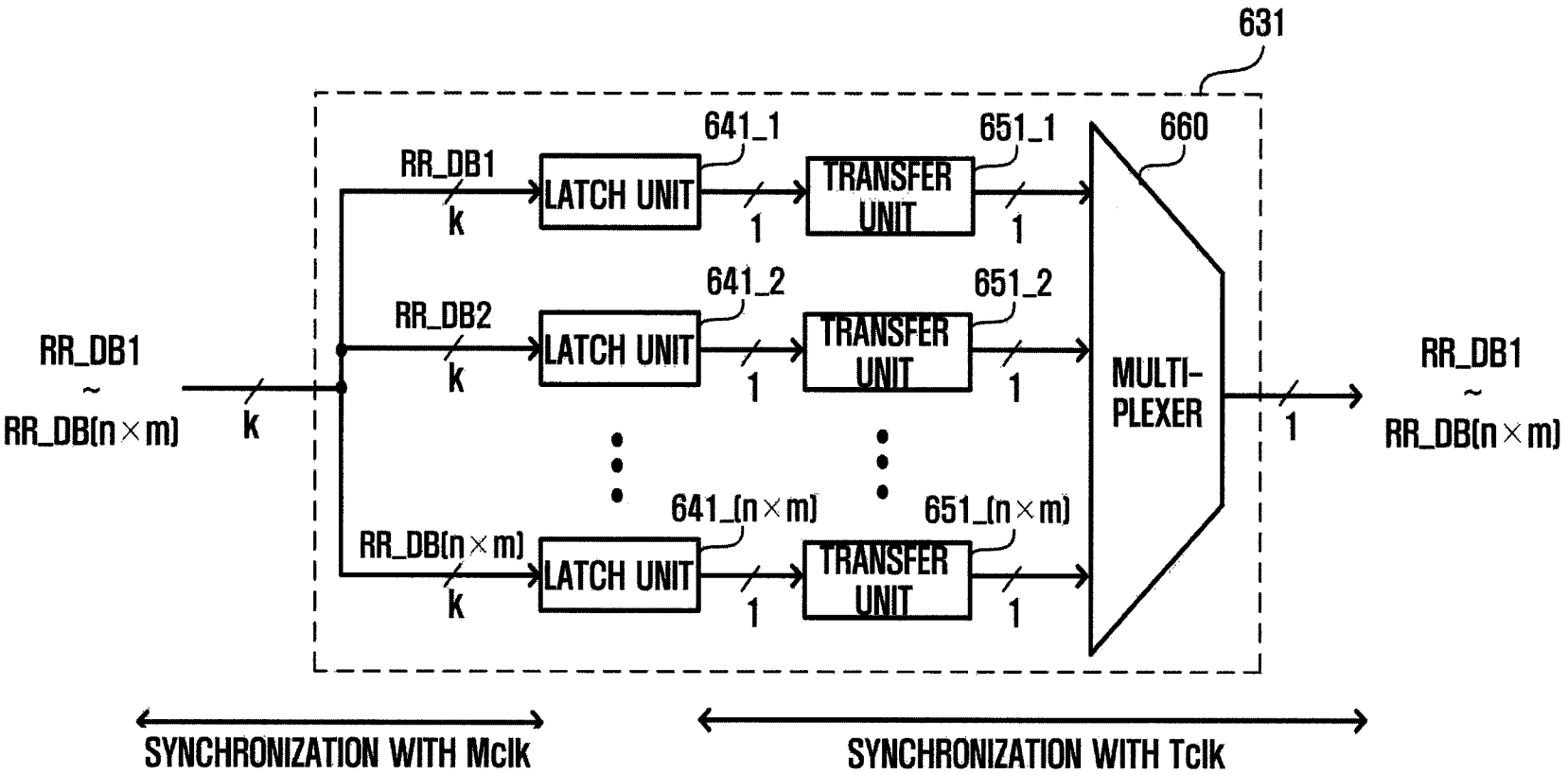
FIG. 7B is a block diagram of a serializer of FIG. 7A.

FIGS. 7A and 7B illustrate a liquid crystal display according to another embodiment of the present invention. FIG. 7A is a block diagram of the liquid crystal display, and FIG. 7B is a block diagram of the serializer of FIG. 7A. The elements common with the embodiment of FIGS. 4 to 6 are labeled with the same reference numerals as in FIGS. 4 and 6, and repetitive description of such elements will be avoided.

In contrast to the embodiment of FIG. 4, the first timing controller 601 of FIG. 7A does not include the memory 620. The representative-value generator 610 outputs the representative image signals RR_DB1, . . . , RR_DB(n×m) in synchronization with the main clock signal Mclk to the serializer 631, and the serializer 631 outputs the representative image signals RR_DB1, . . . , RR_DB(n×m) in series in synchronization with the transfer clock signal Tclk. The frequency of the transfer clock signal Tclk is lower than the frequency of the main clock signal Mclk.

Referring to FIG. 7B, latch units 641_1, . . . , 641_(n×m) in the serializer 631 receive and store the respective representative image signals RR_DB1, . . . , RR_DB(n×m) in synchronization with the main clock signal Mclk. Respective transfer units 651_1, . . . , 651_(n×m) transmit the representative image signals RR_DB1, . . . , RR_DB(n×m) bit by bit from the latch units 641_1, . . . , 641_(n×m) to the multiplexer 660 in synchronization with the transfer clock signal Tclk. The multiplexer 660 transmits the outputs of the respective transfer units 651_1, . . . , 651_(n×m) in series. The multiplexer 660 can be omitted.

Figure 8:
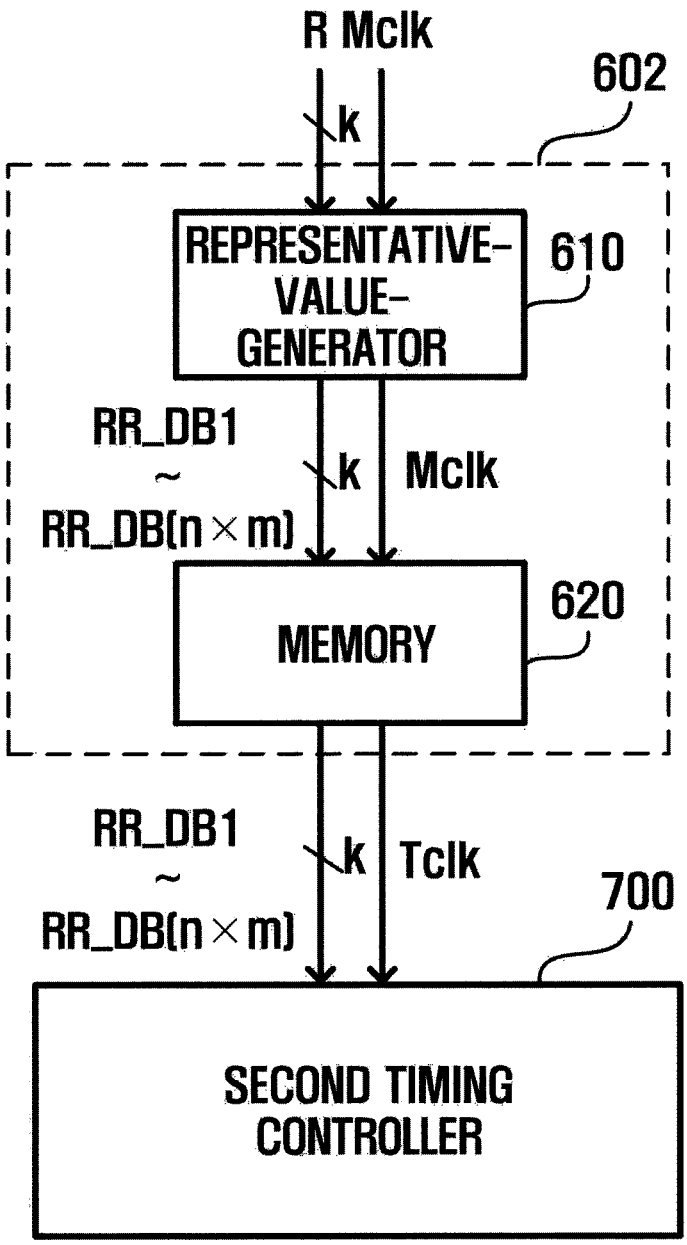
FIG. 8 is a block diagram of the first and second timing controllers in a liquid crystal display according to some embodiments of the present invention.

FIG. 8 is a block diagram illustrating the timing controller according to another embodiment of the present invention. The elements common with the embodiment of FIG. 4 are labeled with the same reference numerals as in FIG. 4, and repetitive description of such elements will be avoided.

In contrast with FIG. 4, the first timing controller 602 of FIG. 8 does not include a serializer. The representative-value generator 610 of FIG. 8 writes the representative image signals RR_DB1, . . . , RR_DB(n×m) to the memory 620 in synchronization with the main clock signal Mclk, and the second timing controller 700 reads out the representative image signals in synchronization with the transfer clock signal Tclk in parallel. The frequency of the transfer clock signal Tclk is lower than the frequency of the main clock signal Mclk.

Figure 9:
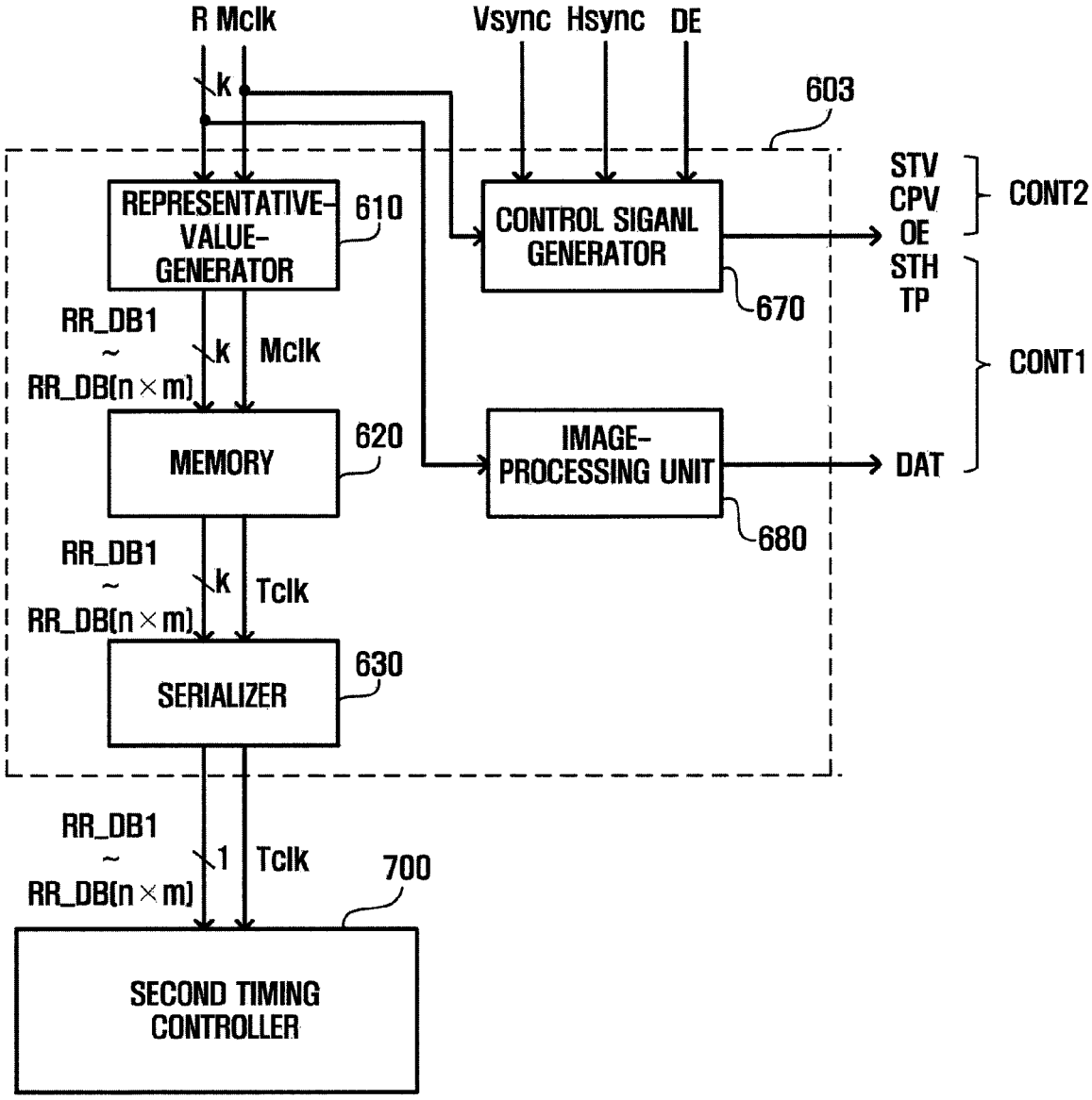
FIG. 9 is a block diagram of the first and second timing controllers in a liquid crystal display according to some embodiments of the present invention.

FIG. 9 is a block diagram of a timing controller according to another embodiment of the present invention. The elements common with the embodiment of FIG. 4 are labeled with the same reference numerals as in FIG. 4, and repetitive description of such elements will be avoided.

The first timing controller 603 of FIG. 9 includes a control-signal-generator 670 and an image-processing unit 680.

The control signal generator 670 receives external control signals Vsync, Hsync, Mclk, and DE, and generates a data control signal CONT1 and a gate control signal CONT2. In some embodiments, the gate control signal CONT2 includes a vertical start signal STV for starting the operation of the gate driver 400, a gate clock signal CPV for determining the time when the gate-on voltage is output, and an output enable signal OE for determining the pulse width of the gate-on voltage. The data control signal CONT1 may include a horizontal start signal STH for starting the operation of the data driver 500, and an output command signal TP for initiating the driving of the image data voltages.

The image-processing unit 680 receives the RGB image signals, processes the received RGB image signals, corrects the RGB image signals as needed to improve the response speed of the liquid crystal molecules and the image quality, and outputs the resulting image data signals DAT.

The embodiments described above illustrate but do not limit the invention.

What is claimed is:

1. A liquid crystal display comprising:

a plurality of light-emitting blocks whose respective luminances are individually controllable in response to supplied and respective luminance control signals;

a plurality of display blocks each having two or more pixels and each corresponding to a respective light-emitting block;

a first timing controller structured and coupled for receiving image signals in synchronization with a supplied first clock signal, the received image signals corresponding to pixels of the display blocks, and for generating and outputting a data control signal corresponding to the image signals and representative image signals that are representative of luminances of respective ones of the display blocks where the representative image signals are output in synchronization with a second clock signal, the frequency of the second clock signal being lower than the frequency of the first clock signal;

luminance control circuitry structured and coupled for controlling luminance of the light-emitting blocks of the liquid crystal display in response to the generated representative image signals;

a second timing controller for outputting backlight data signals corresponding to the representative image signals;

a plurality of backlight drivers for controlling luminance of light-emitting blocks in response to the backlight data signals; and a data driver outputting data signals to the plurality of display blocks in response to the data control signal;

wherein the first timing controller comprises:

a memory;

a representative-value generator for receiving the image signals, generating the representative image signals, and writing the representative image signals to the memory in synchronization with the first clock signal; and a serializer for reading the representative image signals from the memory in synchronization with the second clock signal, and serially outputting the read representative image signals to the second timing controller.

2. The liquid crystal display of claim 1, wherein the first timing controller serially outputs the representative image signals to the second timing controller in synchronization with the second clock signal.

3. The liquid crystal display of claim 1, wherein the generated representative image signals are representative of at least one of average and maximum brightness values of image signals received for the respective display blocks.

4. The liquid crystal display of claim 3, wherein the first timing controller is configured to generate and output the representative image signals by:

writing the representative image signals to a memory in synchronization with the first clock signal;

reading the representative image signals from the memory in synchronization with the second clock signal; and serially outputting the representative image signals read out from the memory to the second timing controller.

5. The liquid crystal display of claim 4, wherein each representative image signal comprises a plurality of bits, and the serializer comprises:

a plurality of latch units for reading the representative image signals from the memory in synchronization with the second clock signal and storing the read representative image signals; and a plurality of transfer units for performing bit-by-bit output of the representative image signals stored in the respective latch units.

6. The liquid crystal display of claim 5, wherein the serializer further comprises a multiplexer that serially transmits output bits of the transfer units.

7. The liquid crystal display of claim 3, wherein the first timing controller comprises:

a representative-value generator for receiving the image signals in synchronization with the first clock signal, and generating the representative image signals that correspond to the respective display blocks;

a plurality of latch units for storing the representative image signals; and a transfer unit for performing bit-by-bit output of the representative image signals stored in the latch units, the bit-by-bit output being performed in synchronization with the second clock signal.

8. A timing controller for use in an image display device, the image display device having a backlighting unit subdivided into a plurality of light-emitting blocks and a display panel subdivided into a plurality of display blocks, the timing controller comprising:

a representative-value generator structured and coupled for receiving a supplied plurality of image signals in synchronization with a supplied first clock signal and for generating therefrom a plurality of representative image signals that are each respectively representative of a respective collection of luminances to be provided by a corresponding one of the light-emitting blocks and a corresponding one of image display blocks of the image display device; and a serializer for serially outputting the representative image signals in synchronization with a second clock signal, the frequency of the second clock signal being lower than the frequency of the first clock signal.

9. The timing controller of claim 8, further comprising a memory;

wherein the representative-value generator writes the representative image signals to the memory in synchronization with the first clock signal, and the serializer reads the representative image signals from the memory in synchronization with the second clock signal.

10. The timing controller of claim 9, wherein each representative image signal comprises a plurality of bits, and the serializer comprises:

a plurality of latch units for reading the respective representative image signals from the memory in synchronization with the second clock signal and storing the read representative image signals; and a plurality of transfer units for performing bit-by-bit output of the representative image signals stored in the respective latch units.

11. The timing controller of claim 10, wherein the serializer further comprises a multiplexer for serially transmitting the output bits of the transfer units.

12. The timing controller of claim 8, wherein the serializer comprises:

a plurality of latch units for storing the respective representative image signals; and a transfer unit for performing bit-by-bit output, in synchronization with the second clock signal, of the representative image signals stored in the respective latch units.

13. A method of driving a liquid crystal display where the display includes a liquid crystal display panel (LCD panel) and a plurality of individually controllable light-emitting blocks structured and disposed for providing respective lights of controlled brightnesses to the LCD panel, the method comprising:

receiving image signals in synchronization with a first clock signal, the image signals representing luminances of pixels within display blocks of the LCD panel, where the display blocks are positioned so as to be respectively illuminated by respective ones of the individually controllable light-emitting blocks;

generating and outputting a data control signal corresponding to the received image signals;

generating and outputting representative image signals in synchronization with a second clock signal, the frequency of the second clock signal being lower than the frequency of the first clock signal;

controlling luminance of the light-emitting blocks in response to the representative image signals; and generating and outputting data signals in response to the data control signal to the LCD panel.

14. The method of claim 13 wherein controlling luminance of the light-emitting blocks in response to the representative image signals comprises:

providing backlight data signals corresponding to the representative image signals; and controlling luminance of the light-emitting blocks in response to the backlight data signals.

15. The method of claim 14, wherein the outputting of the representative image signals in synchronization with the second clock signal comprises outputting the representative image signals in as serial signals that are synchronized to the second clock signal.

16. The method of claim 14, wherein the LCD panel is subdivided into a regular matrix of display blocks which correspond to the respective light-emitting blocks, and the representative image signals are representative values of image signals provided to the respective display blocks.

17. The method of claim 16, wherein the outputting of the representative image signals in synchronization with the second clock signal comprises:

generating the representative image signals that correspond to the respective display blocks;

writing the representative image signals to a memory in synchronization with the first clock signal;

reading the representative image signals from the memory in synchronization with the second clock signal; and serially outputting the read representative image signals.

18. The method of claim 17, wherein each representative image signal comprises a plurality of bits, and the serially outputting of the representative image signals comprises:

storing the read representative image signals in latch units; and outputting, one bit at a time, the representative image signals stored in the latch units.

19. The method of claim 16, wherein the outputting of the representative image signals in synchronization with the second clock signal comprises:

generating the representative image signals that correspond to the respective display blocks;

storing the respective representative image signals in latch units; and in synchronization with the second clock signal, performing bit-by-bit output of the representative image signals stored in the latch units.

* * * * *